United States Patent [19]

Horn

[11] 3,938,599

[45] Feb. 17, 1976

[54] ROTARY DRILL BIT

[75] Inventor: Curtis L. Horn, Houston, Tex.

[73] Assignee: Hycalog, Inc., Houston, Tex.

[22] Filed: Mar. 27, 1974

[21] Appl. No.: 455,339

[52] U.S. Cl. ..... 175/329; 175/410

[51] Int. Cl.[2] ..... E21B 9/36

[58] Field of Search ..... 175/329, 330, 327, 409, 175/410

[56] References Cited

UNITED STATES PATENTS

| | | | |
|---|---|---|---|
| 2,371,490 | 3/1945 | Williams | 175/329 |
| 2,818,233 | 12/1957 | Williams | 175/330 |
| 3,058,535 | 10/1962 | Williams | 175/330 |
| 3,135,341 | 6/1964 | Ritter | 175/329 |
| 3,153,458 | 10/1964 | Short | 175/329 |
| 3,180,440 | 4/1965 | Bridwell | 175/410 X |
| 3,693,735 | 9/1972 | Cortes | 175/329 |
| 3,696,875 | 10/1972 | Cortes | 175/329 |
| 3,709,308 | 1/1973 | Rowley et al. | 175/329 |
| 3,726,351 | 4/1973 | Williams | 175/410 |
| 3,747,699 | 7/1973 | Feenstra et al. | 175/329 |

*Primary Examiner*—David H. Brown
*Attorney, Agent, or Firm*—Marvin B. Eickenroht; W. F. Hyer

[57] ABSTRACT

A rotary drill bit for drilling earthen formations is provided with a plurality of discrete cutting teeth disposed on the lower face of the bit body and arranged in circumferentially spaced, generally radially extending rows. Each of the teeth has a large diamond (or a diamond-like material) set in its leading face at its peak and may have the balance of its leading face as well as its sides provided with smaller flush mounted diamonds. Alternatively, the teeth can be provided with a synthetic diamond or a sintered diamond facing which can extend to the peaks thereof. Fluid courses extend from a central passage in the bit along the leading faces of the teeth so as to discharge fluid against these leading faces and wash the cuttings away therefrom into the valleys between adjacent ones of the teeth. In one aspect, the teeth are mounted on lands on the bit body and recessed areas are provided between the lands so that the primary pressure drop of the fluid will be in the vicinity of the teeth thereby enhancing the action of the drilling fluid in moving the cuttings from in front of the teeth and through the valleys therebetween into the recessed areas.

11 Claims, 6 Drawing Figures

ROTARY DRILL BIT

This invention relates to diamond rotary drilling bits particularly adapted to drill softer earthen formations than are conventional diamond drilling bits.

Conventional diamond rotary drilling bits have a bit body with a lower or drilling face which may be of various cross-sectional configurations and in which diamonds are set to protrude slightly outwardly of the drilling face. In the softer formations, the diamonds tend to become buried in the formation so that the drilling weight on the bit is taken by the bit body or matrix and not by the diamonds. This also may and will cause the fluid courses to become clogged with the formation material so that the drilling fluid cannot adequately flow from the bit and perform its intended function of assisting in the removal of the formation. As a result drill string pressure increases and drilling ceases.

In accordance with the present invention, a diamond rotary bit is provided for drilling of softer formations while avoiding or substantially minimizing the difficulty mentioned above. Thus, the bit is provided with a body having a plurality of discrete teeth arranged in circumferentially spaced and generally radially extending rows with each of the teeth having a leading face and a peak and adjacent teeth having a valley therebetween. The teeth preferably have a large diamond set at the peak and at the leading face so that these diamonds at the tips of the teeth bear the brunt of the abrasive digging action of the teeth and also serve to protect the teeth from excessive tip wear. The remaining face and sides of the teeth can be provided with flush mounted diamonds to further protect the teeth from abrasive wear.

While diamonds are presently preferred, other materials having applicable physical characteristics approaching those of a diamond may be used. One example of such material is boron nitride.

Also, the leading faces of the teeth can be provided with a layer of synthetic diamond or of sintered diamonds which extends to the tip of the teeth thereby replacing the large diamond and the face mounted flush diamonds mentioned above.

A plurality of fluid courses are provided to discharge drilling fluid along the leading faces of the teeth. Thus, the fluid is directed against the formation adjacent the leading faces of the teeth from whence it can sweep the cuttings from the leading face of the teeth through the valleys between the teeth and thence upwardly and away from the bit. In a preferred embodiment, the arrangement of fluid courses and the configuration of the lower face of the bit body is such that a major portion of the energy of the flushing fluid is expended in the vicinity of the leading faces of the teeth to enhance the flushing action of the fluid in removing cuttings. The bit body can have lands on which the teeth are formed on the lower face of the bit body and also can have recessed areas between adjacent lands. With the fluid courses then being formed as grooves in the lands along the leading faces of the teeth, the major portion of the energy of the flushing fluid will be directed toward removing cuttings from the vicinity of the leading edges of the teeth to flush the cuttings through the valleys between the teeth and thence out through the recessed areas to junk slots at the periphery of the bit. Also, in this arrangement, a portion of the lands adjacent the leading edges of the grooves can serve to limit the depth of penetration of the teeth into the formation and to limit the flow of fluid from the grooves into a preceding recessed area.

Figure 1:
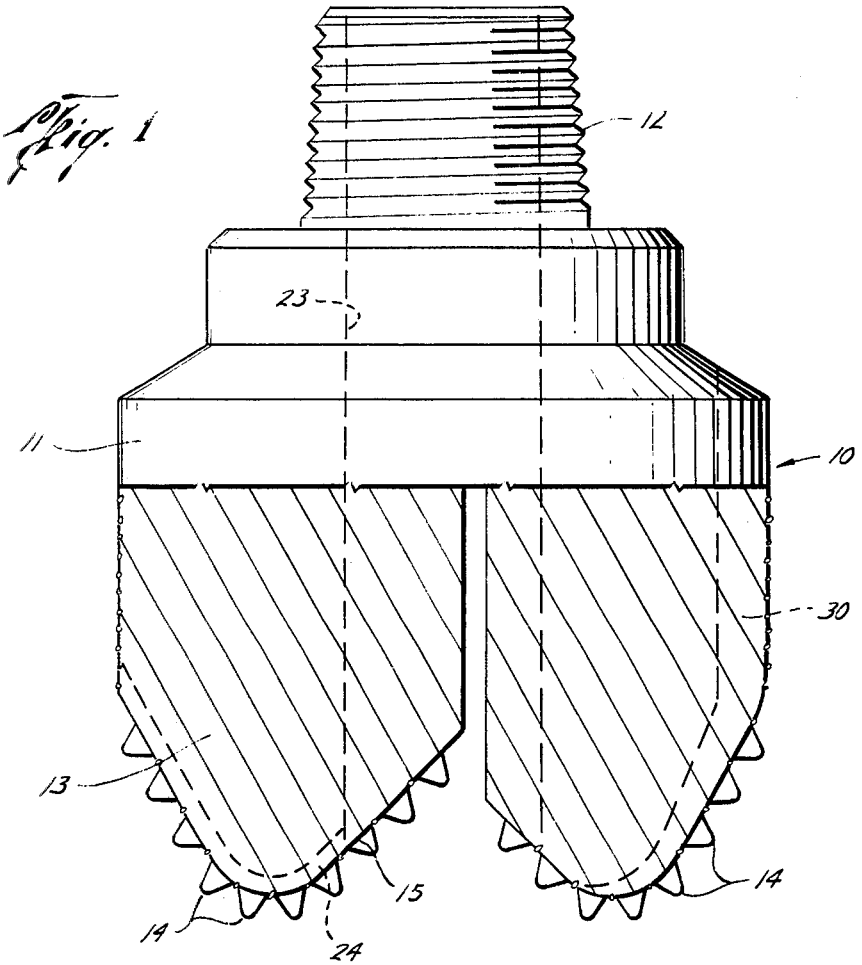
FIG. 1 is a vertical view with the upper part in elevation and the lower part in section of a preferred embodiment of the bit of this invention.
Figure 2:
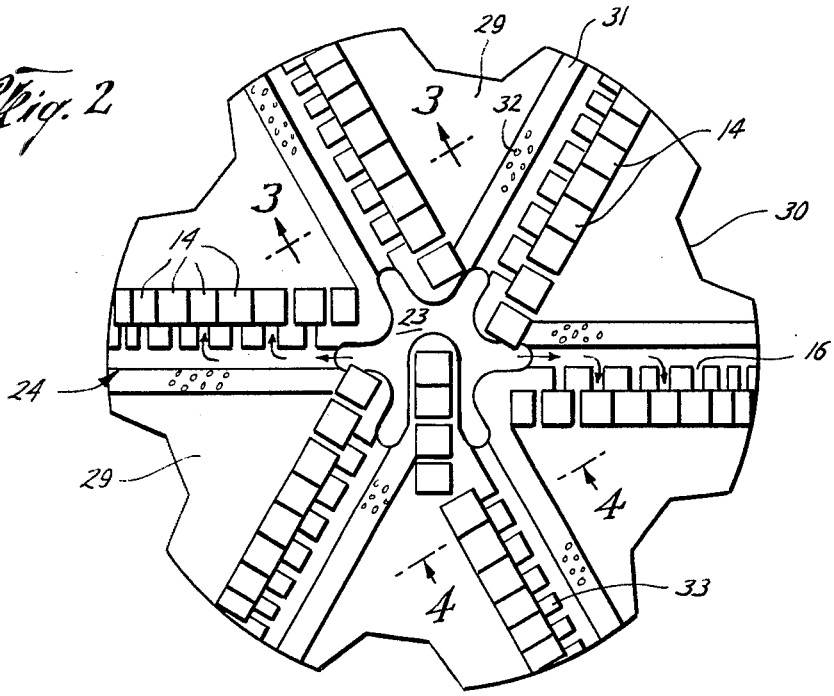
FIG. 2 is view looking upwardly at the bottom of the bit of FIG. 1.

Referring now to the drawings, the bit 10 has a body 11 having an upper threaded pin 12 for attaching the bit to the lower end of a drill string (not shown).

In general, the body 11 of the bit includes a matrix portion 13 of a known type. A plurality of discrete cutting teeth 14 are disposed on the lower face 15 of the bit body in circumferentially spaced and generally radially extending rows. The teeth can be formed integrally with matrix portion 13 and may themselves comprise matrix material except for the diamonds set in the teeth as hereinafter described. While six rows of teeth are shown in the drawing, a lesser or greater number can be employed depending on various factors such as the type of formation to be cut, cost, etc. In any event, the teeth are preferably arranged in such a way as to give a uniform coverage of the formation face being drilled for each revolution of the bit in the sense that the formation is removed entirely across the bottom of the hole. In this connection, it will be noted that at least some of the teeth at the outer periphery of the bit are arranged to cut the sides of the borehole to gage. Also, while the specific bit illustrated in the drawings has a body with a lower face which, in cross-section, appears as a double cone, the face can take other configurations.

Figure 3:
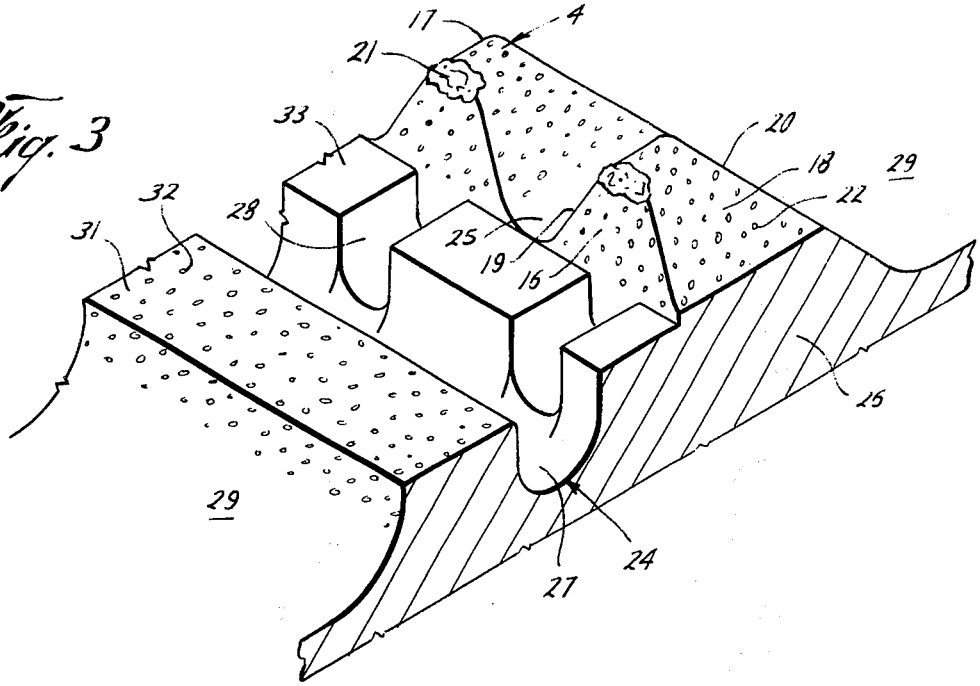
FIG. 3 is a view taken generally on the line 3—3 of FIG. 2 but rotated somewhat as to better illustrate the arrangement.
Figure 4:
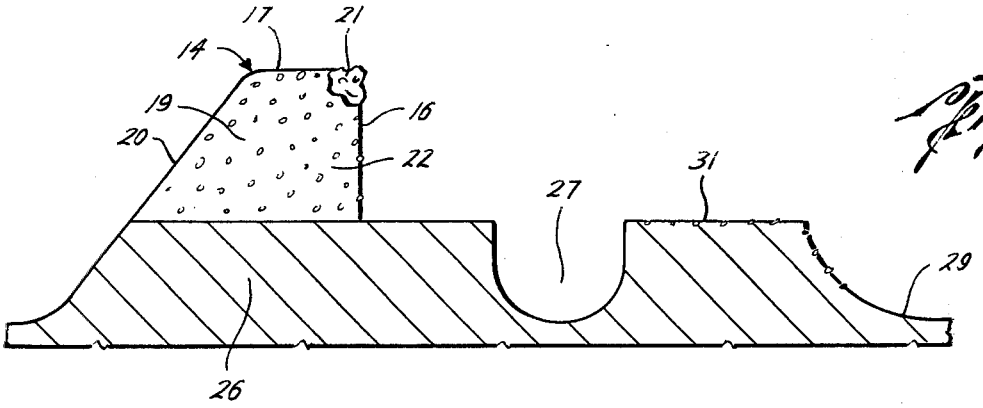
FIG. 4 is a view taken on the line 4—4 of FIG. 2.

A typical tooth is shown in FIGS. 3 and 4. It includes a leading edge of face 16 which is preferably flat. It has side faces 18 and 19 which converge toward the peak or tip 17 and a truncated rear portion 20 which is preferred but the rearward portion of the tooth can take other configurations. A large diamond 21 is set in the matrix of the tooth tip and adjacent its leading edge. It is the intent that diamond 21 conforms as closely as possible with the surfaces of the tooth in which it is set depending on the shape of the diamond. It can be a cut-faced stone, an irregular stone or a cubed diamond but, in any event, should be large enough so that it will take the brunt of the force of the tip portion of the tooth against the formation.

The balance of the leading faces of the tooth as well as its sides can be provided with small flush mounted diamonds 22 to protect these areas of the tooth from excessive wear by virtue of contact with the formation or by being subjected to the scrubbing action of the drilling fluid as it flows past the tooth as described below.

As shown in the drawings, the bit body is provided with a central passage means 23 for receiving a drilling fluid from the drill string. This means can open out at the bottom of the bit body into a plurality of fluid courses 24 which extend from the fluid passage means along the leading faces of the teeth and are arranged to discharge fluid along such leading faces to cool the diamonds in the teeth and to displace cuttings from in front of the teeth. In this connection, the teeth are arranged so that there is a valley 25 between adjacent teeth through which the drilling fluid can carry cuttings to the trailing edge of the teeth.

In a preferred embodiment, the teeth and fluid courses are disposed on and in a land generally indicated by the numeral 26. The fluid courses are then formed by primary grooves 27 in land 26 spaced from the leading edge of the teeth and connected thereto by secondary grooves 28 which permit fluid to flow from the primary grooves to the leading edge of the teeth. The areas 29 between adjacent rows of teeth can be recessed and in fluid communication with junk slots 30 extending vertically along the sides of the bit body. By making the recesses and junk slots sufficiently large, a large portion of the pressure drop of the drilling fluid will occur in the vicinity of the teeth and hence the scrubbing action of the drilling fluid will be most intense at the points where it is most needed to remove the cuttings in order to reduce their tendency to impede the cutting action of the teeth.

In order to assure that the drilling fluid flows primarily across the teeth without excessive flow thereof from a particular water course to the recessed area immediately preceding such course, lands 26 can be shaped to provide radially extending shoulders 31 which have limited clearance, if any, with the uncut formation preceding any particular row of teeth to thereby limit the flow of fluid out of the primary grooves 27 into the preceding low pressure recessed areas. Shoulders 31 can also function to limit the depth of penetration of the teeth into the formation. In this connection, it is usually preferred to provide a series of diamonds 32 inset in shoulder 31 to prevent excessive wear of this shoulder.

With the foregoing specific arrangement of the water courses, there will be portions 33 of land 26 which extend between the secondary grooves to, at least in part, impede flow of drilling fluid from the primary grooves directly into the valleys between successive teeth. The depth of portions 33 and the depth of the secondary grooves 28 can be adjusted relatively to each other and to the depth of the valley between the teeth to proportion the amount of drilling fluid which moves directly through the secondary grooves 28 to the leading face of the teeth and that which flows directly across portions 33 and thence through the valley between the teeth.

Figure 5:
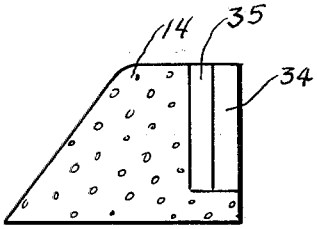
FIG. 5 is a side view of a tooth of the bit showing another embodiment of a tooth.
Figure 6:
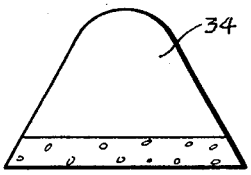
FIG. 6 is a front view of the tooth shown in FIG. 5.

Referring to FIGS. 5 and 6, another embodiment of a tooth 14 is shown wherein the diamond 21 and the flush mounted diamonds 22 in the leading face of the tooth have been replaced with a synthetic diamond shape 34. This synthetic diamond is shown as a slab-like shape having a configuration at least approaching that of the teeth 14 of FIGS. 3 and 4. However it can assume other configurations such as semi-circular. It can be mounted on a blank 35 of sintered carbide which in turn is bonded to and supported by the matrix of the remaining portion of the tooth.

Figure 7:
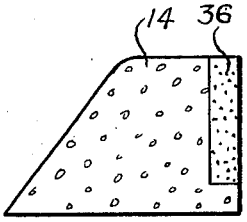
FIG. 7 is a view similar to that of FIG. 5 but showing yet another embodiment of a tooth.

Still another tooth embodiment is shown in FIG. 7 wherein the synthetic diamond-sintered carbide blank 34–35 of FIGS. 5 and 6 is replaced by a sintered natural diamond compact 36.

Various combinations of the foregoing can be chosen for providing the leading faces and the forward portions of the tips of the teeth. Also, as indicated above, materials other than natural or synthetic diamonds or sintered diamonds can be used provided such materials have applicable physical characteristics approaching those of diamonds, e.g., boron nitride. In any event, it will be seen that the teeth are comprised of such materials disposed as disclosed above and supported or backed up by the matrix of the tooth. Thus each tooth is a composite of a body of matrix with diamonds or other similar elements disposed therein or thereon. In this connection, the words "tooth" or "teeth" are used herein to mean such a composite or composites each of which individually extends a substantial distance from the main body of the bit so that when arranged in a row, there will be substantial valleys between adjacent teeth which valleys are formed at least in part by adjacent opposing walls of the adjacent teeth. The terms are not intended to include a blade radially disposed on the bit body and having diamonds set in its leading edge.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. In a rotary bit, a body having a lower face and a central passage means for receiving a drilling fluid; a plurality of discrete cutting "teeth" disposed on said face and arranged in circumferentially spaced generally radially extending rows, each of said teeth having a leading face and a tip and adjacent ones of the teeth having a valley therebetween, each of said teeth having a diamond-like element in its leading face and at least at its tip; and fluid courses extending from said passage means along the leading faces of said teeth and arranged to discharge fluid along the leading faces of said teeth, the fluid courses including primary grooves in said face spaced circumferentially ahead of a row of teeth and a plurality of secondary grooves extending from the primary grooves to the leading faces of the teeth.

2. The bit of claim 1 wherein the diamond-like elements have cutting edges extending laterally across at least a part of the leading face of the teeth with which they are respectively associated.

3. The bit of claim 1 wherein the diamond-like elements are synthetic diamonds each covering a substantial portion of the leading face of its respective tooth.

4. The bit of claim 1 wherein the diamond-like elements are sintered diamond compacts each covering a substantial portion of the leading face of its respective tooth.

5. The bit of claim 1 wherein the diamond-like elements are natural diamonds disposed in the leading faces and at the tips of the teeth, at least a portion of the balance of the leading faces of said teeth have flush mounted diamonds therein.

6. The bit of claim 5 wherein the sides of the teeth are covered with small flush mounted diamonds.

7. In a rotary bit, a body having a lower face and a central passage means for receiving a drilling fluid; said body having a plurality of circumferentially spaced generally radially extending lands thereon with recessed areas between the lands; a plurality of discrete "teeth" disposed along said lands and each having a leading face and a tip, each of said teeth having a diamond-like element in its leading face and at least at its tip; and fluid courses in said lands extending along the leading faces of said teeth so as to permit cuttings to be flushed between the teeth into the recessed areas, the fluid courses including primary grooves in the lands adjacent the leading faces of the teeth and a plurality of secondary grooves extending from the primary grooves to the leading faces of the teeth, the lands adjacent said fluid courses serving to limit the penetration of the teeth into the formation and to direct flow of fluid from the fluid courses directly into said recessed areas without flowing between the teeth.

8. The bit of claim 7 wherein the body has a plurality of circumferentially spaced junk slots about its circumference communicating with said recessed areas to facilitate passage of cuttings up around the bit.

9. The bit of claim 7 wherein the diamond-like elements have a cutting edge extending laterally across at least a part of the leading face of said teeth.

10. The bit of claim 9 wherein the balance of the leading face of said teeth is provided with flush mounted diamonds.

11. The bit of claim 10 wherein the sides of the teeth are covered with small flush mounted diamonds.

* * * * *